United States Patent [19]

Gray et al.

[11] Patent Number: 4,731,617

[45] Date of Patent: Mar. 15, 1988

[54] APPARATUS AND METHOD FOR MAKING PARABOLOIDAL SURFACES

[76] Inventors: Robert E. Gray, Apt. #4, Pretoria Avenue, Ottawa, Ontario, K1S 1W9, Canada; Donald F. Lahey, R.R. #2, Plantagenet, Ontario, Canada

[21] Appl. No.: 897,879

[22] Filed: Aug. 19, 1986

[51] Int. Cl.[4] ..... H01Q 15/14

[52] U.S. Cl. ..... 343/912; 72/56

[58] Field of Search ..... 343/912; 72/56, 57, 72/58, 304, 305, 10

[56] References Cited

U.S. PATENT DOCUMENTS 3,024,525 3/1962 Wisberger ..... 343/912
3,890,819 6/1975 DeLuca ..... 72/57
4,011,744 3/1977 Ershov et al. ..... 72/57
4,352,112 9/1982 Leonhardt et al. ..... 343/912

*Primary Examiner*—William L. Sikes
*Assistant Examiner*—Robert E. Wise
*Attorney, Agent, or Firm*—Burke-Robertson, Chadwick & Ritchie

[57] ABSTRACT

An apparatus and method for making paraboloidal surfaces for example for paraboloidal reflector antennas. The apparatus and method provides a rigid annular clamping ring of sufficient rigidity to provide even distribution of clamping forces, to clamp a disc-shaped sheet on a table so that the sheet may be pneumatically deformed while held in position to prevent inward slippage of the sheet during the deforming process.

19 Claims, 8 Drawing Figures

APPARATUS AND METHOD FOR MAKING PARABOLOIDAL SURFACES

The present invention relates to apparatus and the method for making paraboloidal surfaces which have particular application in the fabrication of parabolic reflector antennas for use, for example, as microwave or VHF antennas.

BACKGROUND OF THE INVENTION

Parabolic reflector antennas of the general class to which this invention relates are customarily made in several different manners. For instance they may be spun from a material such as aluminum or formed on a hydroforming press. Each of these methods of making a dished reflector has its disadvantages. Spinning as a method for making a dished reflector requires that the reflector be made from a metal that can be drawn or spun such as aluminum. This is a limitation and often results in higher costs. Also it may be necessary to anneal the metal during the spinning process, thereby adding to the cost. With hydroforming, the reflector can be made of any metal. Martin U.S. Pat. No. 3,672,194 issued June 27, 1972 describes and illustrates a hydroforming apparatus for shape forming sheet elements in which a disc-like sheet element is clamped in a press and expanded using hydraulic fluid into a die element of appropriate contour. The expense of such equipment obviously adds to the cost of the product as well as the availability of the method.

Yet another method of forming dished reflectors has been to expand a membrane into a hardenable material, and maintaining the membrane in an appropriate expanded state until the material hardens (see for example Wilenius et al U.S. Pat. No. 3,251,908 issued May 17, 1966 and Bagby U.S. Pat. No. 3,337,660 issued Aug. 22, 1967). Fassnacht et al U.S. Pat. No. 3,184,210 issued May 18, 1965 describes and illustrates a method of constructing a dished reflector in which a collapsible bladder is expanded to provide a mold pattern and a casting material is then sprayed on the contoured surface of the bladder and cured to provide a cast reflector surface which is a duplicate of the image surface of the inflatable bladder. All of these methods require significant technical expertise on the part of the persons who are making the reflectors and, often, expensive and sophisticated apparatus.

Others have developed methods and apparatus for shaping of paraboloidal surfaces by applying pressure to the central portion of a disc-like sheet while the sheet is overlying a backing disc and secured by a peripheral clamp ring so as to cause the central portion of the workpiece to distend outwardly into a dome-shaped product. Often the sheet is made of metal and the pressure is applied pneumatically. U.S. Pat. No. 3,934,440 of Berg issued Jan. 27, 1976 and U.S. Pat. No. 3,572,071 of Semplak issued Mar. 23, 1971 as well as Clough Canadian patent No. 640,483 issued May 1, 1962 are representative of this approach. This approach is economically attractive, since a die to receive and form the expanded sheet is not required. As well, it has been found that where a circular disc is used, a uniform pressure, sufficient to substantially exceed the elastic limit of the sheet material and thus to permanently deform it, results in a surface which is generally paraboloidal to a sufficiently high degree of approximation to be useful as a parabolic reflector antenna. One of the main problems experienced with this approach however has been in the clamping of the edges of the sheet. If the clamping is not uniform, circumferential buckling or wrinkling of the sheet may result. The apparatus of Berg U.S. Pat. No. 3,934,440 requires a clamping mechanism which permits controlled slippage of the margin of the sheet with respect to the clamps. Clough Canadian patent No. 640,483 describes and illustrates a clamp mechanism which comprises a single, massive piston which moves upwardly, into position to clamp the edges of the sheet between the piston's upper surface and a cooperating die.

Other patents of general background interest describing other constructions of parabolic reflector antennas are U.S. Pat. No. 4,455,557 of Thomas issued June 19, 1984, Canadian patent No. 1,121,911 of Vines issued Apr. 13, 1982 and Canadian patent No. 716,197 of Richards issued Aug. 17, 1965.

OBJECTS OF THE INVENTION

It is an object of the present invention to provide a means and method of forming paraboloidal surfaces from disc-like sheets of material such as metal by applying pressure to the central portion of the sheet, wherein the margins of the sheet material are uniformly clamped in a novel fashion. It is a further object of the present invention to provide an economical method and means for manufacturing parabolic reflectors.

SUMMARY OF THE INVENTION

In accordance with the present invention there is provided a novel apparatus for dishing a circular flat sheet of deformable material. The apparatus comprises a base frame and a circular sheet-receiving table supported by the base frame. A plurality of clamping means are supported by the base frame and are spaced equally about the periphery of the table. The clamping means each have a clamping surface. Each clamping surface of each clamping means when in clamping position is oriented to direct clamping force downwardly towards the table surface. A rigid annular clamping ring is provided having an upper surface to receive each of the clamping surfaces of the clamping means when in clamping position and a lower clamping surface to bear against the upper surface of the sheet when in position on the table. The clamping ring is of sufficient rigidity to permit even distribution of clamping forces from the clamping means about the lower clamping surface. An upstanding swaging means is supported on the surface of the table to uniformly engage and upwardly turn the edge of the sheet when under clamping pressure from the clamping ring. The apparatus further comprises fluid supply means communicating with the surface of the table to supply fluid between the sheet and table surface for deforming and thereby shaping the sheet. Control means are associated with the fluid supply means to provide appropriate fluid for deforming and shaping the sheet. Gasket means are provided on the table surface to extend between the table surface and the sheet and prevent fluid leaking during deformation of the sheet when the clamping means are in clamping position. The clamping means provide sufficient force on the clamping ring to hold the sheet in position, upwardly turn the edge of the sheet against the upstanding swaging means, prevent escape of fluid from between the sheet and table surface and prevent inward slippage of the sheet during the deforming operation.

In addition, there is provided in accordance with the present invention a method of dishing a flat circular sheet of deformable material when positioned on a table surface. In accordance with this method, the sheet is clamped onto the table surface along a concentric path spaced inwardly from the peripheral edge of the sheet. The peripheral edge of the sheet is bent to flare upwardly and outwardly, while thus clamping the sheet onto the table surface. The sheet is then deformed into a concave shape by supplying appropriate fluid pressure between the table surface and the sheet while clamping the sheet along the same concentric path with sufficient force to maintain a fluid seal between the table and the sheet and prevent inward slippage of the sheet. The fluid pressure is then removed to permit removal of the deformed sheet.

The apparatus and method according to the present invention provide an economical, effective way to deform flat circular sheets, for example of aluminum or other appropriate metal, into parabolic reflector antennas. The product produced in accordance with the apparatus and method of the present invention has a concave interior shape approximating that of a paraboloid, thereby making it possible to be used as a parabolic reflector antenna. The apparatus is relatively simple and straightforward to construct and operate. The method and apparatus are suitable not only for fabrication of antennas from single sheets of single material; the apparatus and method also permit fabrication of such antennas from scraps of material which have been formed together—e.g. sheets of aluminum which have been welded together.

The method and apparatus also lend themselves to forming of perforated sheets by using an appropriate interior membrane, such as one of neoprene, to provide a seal and supply the outward force on the inner surface of the perforated material as it is held on the table. Antennas made of such perforated sheets provide less wind resistance, a distinctive advantage for larger antennas.

In addition, the apparatus of the present invention may be readily adapted to different sizes of antennas. For larger antennas, for instance, a larger table and more clamps may be required. Appropriate modifications however may be readily made to the apparatus to achieve this end.

BRIEF DESCRIPTION OF THE DRAWINGS

These and other objects and advantages of the invention will become apparent upon reading the following detailed description and upon referring to the drawings in which.

Figure 1:
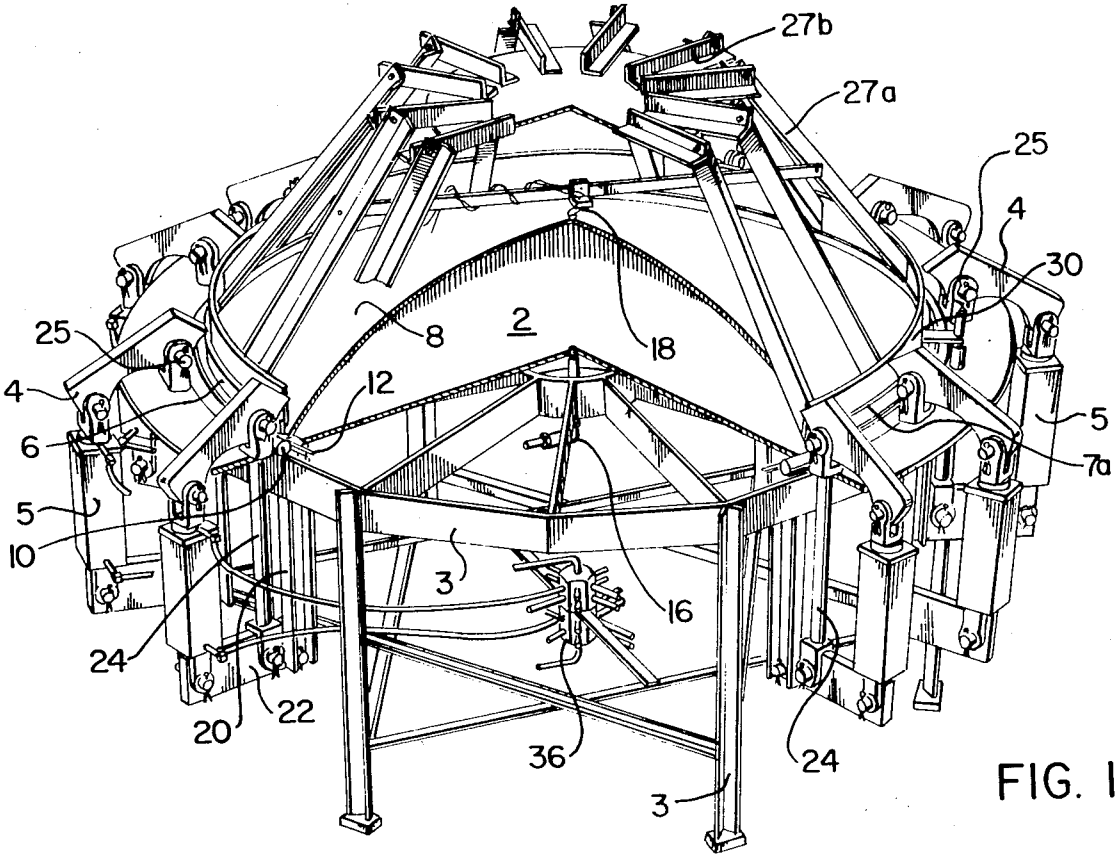
FIG. 1 is a perspective view of an example embodiment of the apparatus, partially broken away, in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 2:
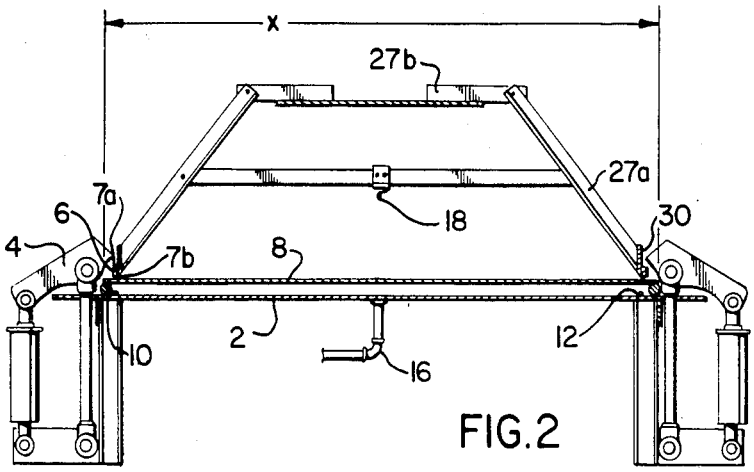
FIGS. 2, 3 and 4 are schematic elevation section views of the apparatus of FIG. 1 during various stages of the operational cycle of the apparatus.
Figure 3:
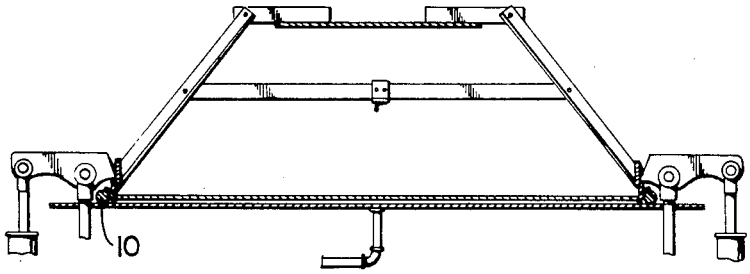

Turning to the drawings there is shown in FIG. 1 a perspective view of the antenna forming apparatus of the present invention. A table 2 supported on a frame 3 has a series of clamping lever arms 4 arranged around its periphery and actuated by means of hydraulic cylinders 5. These clamps, shown in retracted position in FIGS. 1 and 2, are designed to engage the upper edge *7a* of clamping ring 6 so that knurled lower edge *7b* of clamping ring 6 presses against the circular sheet 8 of aluminum (or any other appropriate substance preferably metal) to be formed into an antenna, to hold the sheet in place. (Clamping ring 6 is made with sufficient rigidity to permit even distribution of the force from clamps 4 about lower edge *7b*.) The sheet 8 in turn initially rests on a swaging element in the form of edge turning ring 10 (FIG. 2). The clamps are activated simultaneously by hydraulic pressure from ram extension manifold 36 to turn the edge of the disc until the bottom of the disc presses against a neoprene O-ring seal 12 (FIG. 3). The hydraulic clamping force produced by cylinders 5 is set to a value sufficient to prevent inward slippage of the aluminum disc during the inflation process.

Air is introduced into the centre of the table through a pipe 16 and is prevented from escaping from between the sheet 8 and table 2 by the O-ring seal 12. As the pressure between the sheet 8 and table 2 increases, the metal yields to form a close approximation to a parabolic shape. (The range of air pressures required may be about 15 to 30 p.s.i., for example, depending on the thickness, diameter and desired curvature of the antenna being formed.) This shape rises inside the stiffened clamping ring until it reaches a preset height defined by the position of a micro-switch 18, which controls a valve (not shown) admitting air into the inside of the disc. When the switch opens, the inflation process terminates. Air pressure is then released, the hydraulic cylinders 5 controlling the clamping ring are deactivated and the clamping bars 4 return to the position shown in FIG. 1. The clamping ring can then be removed and the formed antenna is removed and replaced with a new disc and the process repeated. In the retracted position, the clamping lever arms 4 are arranged as illustrated in FIG. 2 to permit complete removal of clamping ring 6 and the insertion of the next disc to be formed. The maximum diameter of the disc which can be inserted is shown as the dimension x in FIG. 2.

The design of the clamping system will now be discussed in more detail with the help of FIG. 1. The clamping arm 4 pivots on a clevis 25 attached to a tension rod 24 which transmits the force to a transfer bar 22 secured to frame 3. An hydraulic cylinder 5 is attached between the clamping arm 4 and the transfer bar 22 while a compression member 20 is used to return the reaction force back to a point as close as possible to a point directly under the clamping ring 6. In this way, twisting forces on the table are minimized.

Turning now to the design of the clamping ring, the force from the clamping bars 4 is spread evenly around clamping ring 6. For this reason, the clamping ring must be made strong enough to prevent upward flexing between clamps. In addition, the application of the clamping force should not introduce any outward or inward twist into the clamping ring. Some twist however is unavoidable because of manufacturing tolerances. To minimize this, cross ring stiffening is provided by beams 27*a* and 27*b* and reinforcing ring 30 but in such a way that inflation of the disc can occur without interference from the stiffening members.

Figure 4:
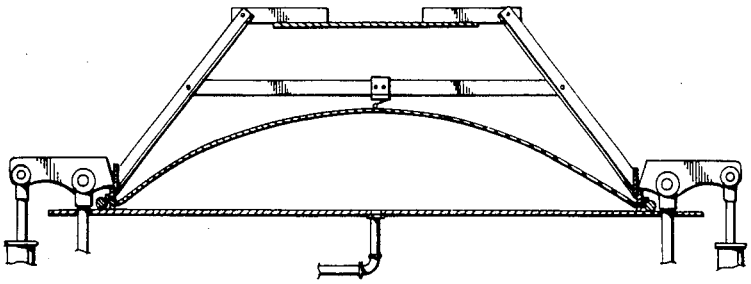
Figure 6:
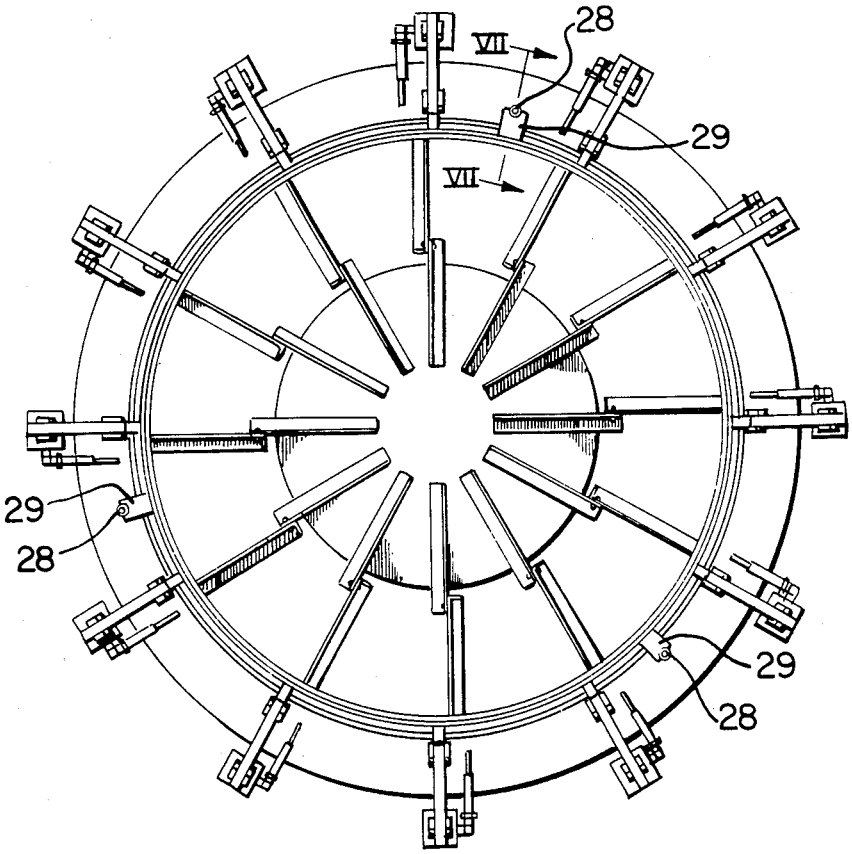
FIG. 6 is a plan view of the apparatus of FIG. 1.
Figure 7:
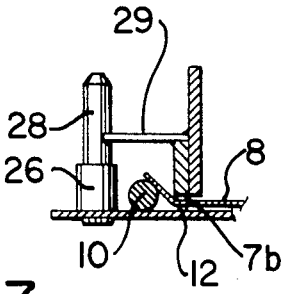
FIG. 7 is a side, schematic partial view, in partial section, along line VII—VII of FIG. 6, of the sheet and clamping ring centering mechanism of the apparatus of FIGS. 1 to 6.

The antenna forming operation commences when a sheet 8, preferably of aluminum is laid on top of the edge turning ring 10 and located by means of sleeves 26 on three upstanding pins 28 (FIG. 7). The clamping ring is then lowered over the table with the three location plates 29 engaging pins 28, so that the ring is properly located with respect to the table and sheet 8 (FIGS. 6 and 7). When clamping ring 6 makes contact with sheet 8, knurled edge 7*b* grips the sheet 8 and its edge is turned by the edge turning ring 10 (FIG. 3). Finally, when sheet 8 reaches the O-ring 12, the edge has been turned the desired amount and after the clamping force has reached its desired value, inflation can begin (FIG. 4).

Figure 5A:
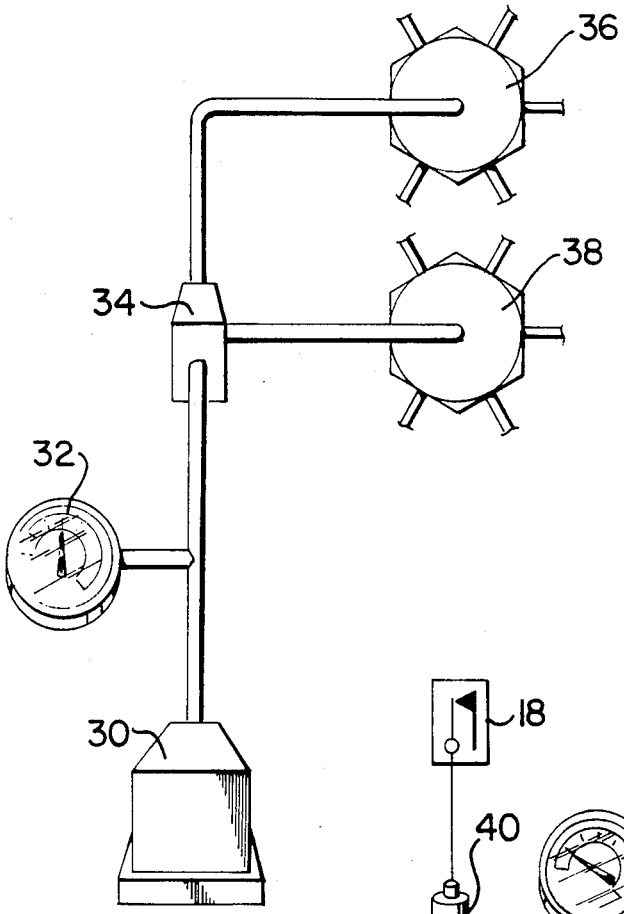
FIGS. 5*a* and 5*b* are schematic diagrams of the fluid drive systems of the apparatus of FIG. 1.
Figure 5B:
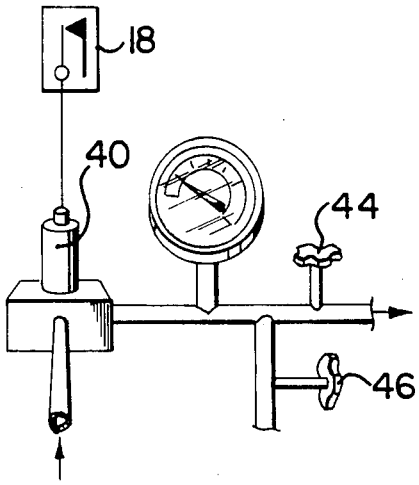

The control means for the apparatus are shown in FIGS. 5*a* and 5*b*. As shown in FIG. 5*a*, an hydraulic pump 30 generates oil pressure as measured by the gauge 32. This pressure is transmitted through a four-way valve 34 to either the ram extension manifold 36 or the ram retraction manifold 38. FIG. 1 shows these two manifolds and a typical connection to one double acting cylinder 5 which is in its fully retracted position.

Also in FIG. 5*b*, it can be seen that air under pressure from a compressor to inflate the disc is fed into the solenoid valve 40 which in turn is controlled by micro-switch 18. When the desired amount of inflation has occurred micro-switch 18 causes an interruption to the flow of air via the solenoid valve 40.

Overall control of the air used for inflation of sheet 8 is achieved by valve 44 while valve 46 is used for air release after inflation is complete.

In operation, starting from the fully retracted position for the hydraulic rams (FIG. 2), clamping ring 6 is removed, a disc of aluminum is placed against its three location points 26 spaced about the periphery of the table 2 (FIG. 1) and the clamping ring lowered and positioned with plates 29 engaging the three pins 28. The hydraulic pump is activated to extend all hydraulic cylinders to the point where the clamping lever arms 4 are fully engaged with and bearing down upon upper edge 7*a* of clamping ring 6. Hydraulic pressure is then increased to the desired amount and held at that value. Next, the air pressure release valve 46 is closed and the air-inlet pressure valve 44 is opened. Inflation of the disc takes places until the microswitch 18 trips. This closes the solenoid valve and prevents further inflation. The inlet valve 44 is closed and the air pressure release valve 46 is opened. The four-way valve 34 is set for retraction and the hydraulic pump is activated until all rams in cylinders 26 have returned to their fully retracted position. The clamping ring 6 can then be lifted off, the antenna formed from sheet 8 removed and a new blank inserted so that the whole cycle can repeat.

It will be understood that if sheet 8 were perforated, so that air otherwise would escape from between the disc and table 2, a bladder of neoprene or other appropriate material may be placed on the inside surface of sheet 8 to prevent the escape of air through the perforations during the inflation step.

As well, it will be understood that the apparatus of the present invention may be appropriately and simply modified to receive and form discs of various size shapes. This may require adding to or reducing the number of clamping lever arms 4 circumscribing the table, and rearranging these clamping bars so that they remain equally spaced. As will be appreciated by one skilled in the art, the construction of the apparatus lends itself readily to such modifications.

One of the key aspects of the present invention is that the clamping forces required for this technique have, heretofore, been more often associated with large expensive hydroform presses. The apparatus according to the present invention has permitted large clamping forces to be developed using relatively inexpensive apparatus which may be readily modified to receive various diameters of sheets to be formed.

Thus it is apparent that there has been provided in accordance with the present invention an apparatus and method for making paraboloidal surfaces that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my Invention:

1. Apparatus for dishing a circular flat sheet of deformable material comprising:

(a) a base frame;

(b) a circular sheet-receiving table supported by the base frame;

(c) a plurality of clamping means supported by the base frame and spaced equally about the periphery of the table, the clamping means each having a clamping surface, each said clamping surface of each clamping means when in clamping position being oriented to direct clamping force downwardly towards the table surface;

(d) a rigid annular clamping ring having an upper surface to receive each of the clamping surfaces of the clamping means when in clamping position and a lower, clamping surface to bear against the upper surface of the sheet when in position on the table to evenly distribute the clamping forces from the clamping means about the lower clamping surface;

(e) an upstanding swaging means supported on the surface of the table to uniformly engage and upwardly turn the edge of the sheet when under clamping pressure from the clamping ring;

(f) fluid supply means communicating with the surface of the table to supply fluid between the sheet and table surface for deforming and thereby shaping the sheet;

(g) control means associated with the fluid supply means for providing appropriate fluid for deforming and shaping the sheet; and (h) gasket means on the table surface to extend between the table surface and the sheet to prevent fluid leaking during deformation of the sheet when the clamping means are in clamping position, the clamping means to provide sufficient force on the clamping ring to hold the sheet in position, upwardly turn the edge of the sheet against the upstanding swaging means, prevent escape of fluid from between the sheet and table surface during the deforming operation and prevent inward slippage of the sheet.

2. Apparatus according to claim 1 further comprising a sheet centering means on the surface of the table.

3. Apparatus according to claim 2 wherein the centering means comprises a plurality of upstanding pins on the table and spaced from each other, to bear against the outer edge of the sheet when the sheet is in centered position on the table.

4. Apparatus according to claim 3 further comprising a clamping ring positioning means associated with the clamping ring to position the clamping ring properly with respect to the sheet during the shaping operation.

5. Apparatus according to claim 4 wherein the clamping ring positioning means comprises a plurality of plates secured to the clamping ring in positions spaced from each other and having slots positioned therein to receive the sheet centering pins when the clamping ring is in proper position.

6. Apparatus according to claim 1 wherein the clamping means are positioned about the periphery of the table surface, each clamping means comprising a lever arm secured to the frame to pivot about an axis parallel to the surface of the table at a position between the ends of the lever arm, the clamping surface being at one end of the lever arm, the lever arms, when moved to non-operative position providing clearance for removal of the clamping ring from the vicinity of the table surface.

7. Apparatus according to claim 6 wherein a fluid operated piston means is provided at the other end of each lever arm to provide movement of the lever arm and provide pressure for the clamping surface.

8. Apparatus according to claim 7 wherein fluid to control the movement and pressure of the clamping means is supplied from a single, central source.

9. Apparatus according to claim 8 wherein the piston of each clamping means is hydraulically driven.

10. Apparatus according to claim 9 wherein air is supplied by the fluid supply means to cause the sheet deformation and shaping.

11. Apparatus according to claim 1 wherein brace means are provided extending across the annular clamping ring to stiffen the ring and prevent outward twist of the ring when under clamping pressure.

12. Apparatus according to claim 1 wherein a contact switch, associated with the control means for adjusting the supply of fluid for the fluid supply means is positioned over the table surface a predetermined height, the contact switch to stop the supply of fluid to the surface of the table when the sheet deformation reaches a predetermined degree and the sheet comes in contact with the switch.

13. Apparatus according to claim 1 wherein the sealing gasket means on the table comprises an O-ring seated in a channel on the table, the O-ring extending around the table so that it will be positioned near the peripheral edge of the sheet when the sheet is positioned on the table.

14. Apparatus according to claim 13 wherein the O-ring is made of neoprene.

15. Apparatus according to claim 1 wherein the lower clamping surface is knurled to achieve a high coefficient of friction without signficant thinning of the sheet being clamped.

16. Apparatus according to claim 1 wherein the table is supported from beneath by a plurality of transfer bars secured to the frame and positioned below the location of the clamping ring to resist the forces exerted on the table by the clamping ring.

17. Apparatus according to claim 1 wherein the sheet is aluminum.

18. Apparatus according to claim 1 wherein the swaging means is an upstanding annular projection located on the surface of the table and extending around the table surface near the periphery of the sheet when the sheet is in position on the table.

19. A method of dishing a flat circular sheet of deformable material when positioned on a table surface, the method comprising the steps of:

(a) clamping the sheet onto the table surface along a concentric path spaced inwardly from the peripheral edge of the sheet;

(b) bending the peripheral edge of the sheet to flare upwardly and outwardly, while thus clamping the sheet onto the table surface;

(c) deforming the sheet into a concave shape by supplying appropriate pneumatic pressure between the table surface and the sheet while clamping the sheet along the same concentric path with sufficient force to maintain a fluid seal between the table and the sheet and prevent inward slippage of the sheet; and (d) removing the fluid pressure to permit removal of the deformed sheet.

* * * * *